US006739885B2

(12) United States Patent
Ward et al.

(10) Patent No.: US 6,739,885 B2
(45) Date of Patent: May 25, 2004

(54) FILTERED AND SHIELDED ELECTRICAL CONNECTOR

(75) Inventors: Bobby Gene Ward, King, NC (US); Larry George Novotny, Clemmons, NC (US); David Allen Klein, Kernersville, NC (US); Michael Henry Banas, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/151,791

(22) Filed: May 21, 2002

(65) Prior Publication Data

US 2003/0220000 A1 Nov. 27, 2003

(51) Int. Cl.[7] ..... H01R 13/648

(52) U.S. Cl. ..... 439/108; 439/607; 439/95; 439/939

(58) Field of Search ..... 439/108, 607, 439/608, 95, 939, 927, 931

(56) References Cited

U.S. PATENT DOCUMENTS

| | | | | | |
|---|---|---|---|---|---|
| 4,386,814 | A | * | 6/1983 | Asick | 439/607 |
| 4,820,174 | A | | 4/1989 | Farrar et al. | 439/95 |
| 4,938,704 | A | * | 7/1990 | Fujiura | 439/95 |
| 5,564,948 | A | * | 10/1996 | Harting et al. | 439/607 |
| 6,066,001 | A | * | 5/2000 | Liptak et al. | 439/607 |
| 6,413,119 | B1 | * | 7/2002 | Gabrisko et al. | 439/620 |

FOREIGN PATENT DOCUMENTS

| | | | |
|---|---|---|---|
| DE | 3736025 C1 | 12/1988 | H01R/13/648 |
| EP | 0 588 714 A2 | 3/1994 | H01R/13/719 |
| GB | 1 522 853 | 8/1978 | H01R/13/66 |
| WO | WO 97/16872 | 5/1997 | H01R/13/658 |

* cited by examiner

*Primary Examiner*—Truc Nguyen

(57) ABSTRACT

An electrical connector assembly includes a pin header 10 that can be mounted in an opening 4 in an electrically conductive case 2. The pin header 10 includes a molded pin header housing 12 that can be used in unfiltered as well as filtered and shielded versions. The filtered and shielded versions include a ground shield 20 or 50 that includes segmented cantilever tangs 26 or 56 extending along peripheral edges of the shield member 20 or 50. These tangs 26 or 58 mechanically grip the electrically conductive case 2 to establish ground continuity. One version of the ground shield 20 can be mounted on a printed circuit board to which filter capacitors 40 are soldered.

14 Claims, 5 Drawing Sheets

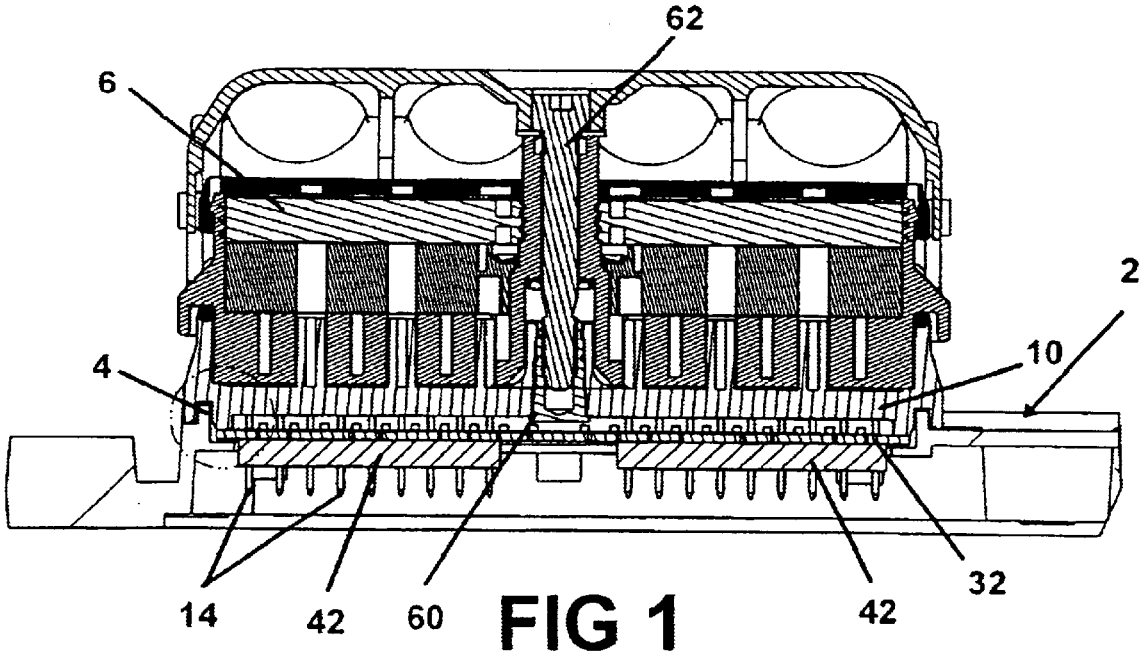
FIG 1
FIG 2
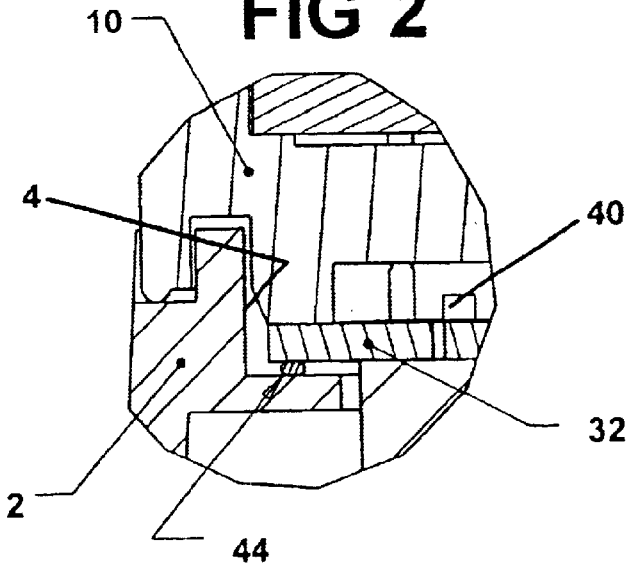

FILTERED AND SHIELDED ELECTRICAL CONNECTOR

BACKGROUND OF THE INVENTION

1. Field of the Invention

This invention relates to shielded and filtered electrical connectors. More specifically this invention relates to a grounding shield that can be used to convert an unfiltered electrical connector to a filtered and shielded electrical connector.

2. Description of the Prior Art

Electrical connectors, especially those used for automotive or motor vehicle applications, often require the use of electrical connectors that can be filtered or shielded. Preferably the filtered version should be very similar, or if possible, identical to the unfiltered version, with only the addition of filtering or shielding means. Additional features on an unfiltered version, whose only purpose is to accommodate filtering means merely add cost to the unfiltered version and therefore need to be avoided if possible. Therefore, the better approach is to provide features on the filtering or shielding means that can be used to mate with an unfiltered electrical connector. Of course features designed into the filtering means to permit use with unfiltered connectors or slightly modified versions of unfiltered connectors, should also be cost effective. Furthermore, when filtered connectors are intended for use in off road motor vehicle applications, the filtering and shielding means must be sufficiently rugged and reliable.

U.S. Pat. No. 5,823,826 discloses an electrical connector assembly in which a metal frame is attached to a printed circuit board on which pins have been mounted. This metal frame can be mounted to a die cast housing having a series of protruding posts insertable into holes flanked by deflectable tabs that engage the posts. However, the connector housing is specially designed for use as a shielded connector and would add cost to an unfiltered or unshielded connector housing of the same general configuration.

SUMMARY OF THE INVENTION

A shielded printed circuit board header assembly according to this invention can be inserted into and mounted in an opening in an electrically conductive case. The assembly includes a molded nonconductive housing with terminals mounted in the housing. A ground shield engages the case when the header assembly is mounted within the opening. Peripheral edges of the ground shield extend at an angle relative to a central portion of the ground shield. The peripheral edges are segmented to form independent side-by-side segmented cantilever tangs, which engage the case along edges of the case to electrically common the ground shield to the case and to mechanically grip the case.

The stamped and formed ground shield member used with this electrical connector comprises a metal plate including tangs extending from each peripheral edge of the metal plate at an acute angle relative to a central portion of the shield. Each tang extends beyond a common side of the metal plate. The tangs extend substantially from end to end of each peripheral edge. Adjacent tangs are separated only by slits having a width less each tang's width. The tangs are positioned to engage a case surrounding the ground shield member and the at least portions of the electrical connector.

The ground shield can be part of a filter assembly for use with an electrical connector including a printed circuit board with capacitors soldered to the printed circuit board for attachment to terminals in the electrical connector. This stamped and formed frame is soldered to and extends around peripheral edges of the printed circuit board. The tangs extend along the peripheral edges of the printed circuit board at an acute angle relative to the printed circuit board. These tangs establish a ground connection with an external member, such as a metal case in which electrical or electronic components or assemblies are housed.

BRIEF DESCRIPTION OF THE DRAWINGS

FIG. 1 is a view, partially in section, of a filtered electrical connector assembly including a pin header mounted within an opening of a metal case surrounding an electrical component or assembly.

FIG. 2 is a view showing the position on one edge of the pin header of FIG. 1 mounted within the case opening.

DETAILED DESCRIPTION OF THE PREFERRED EMBODIMENTS

Figure 3:
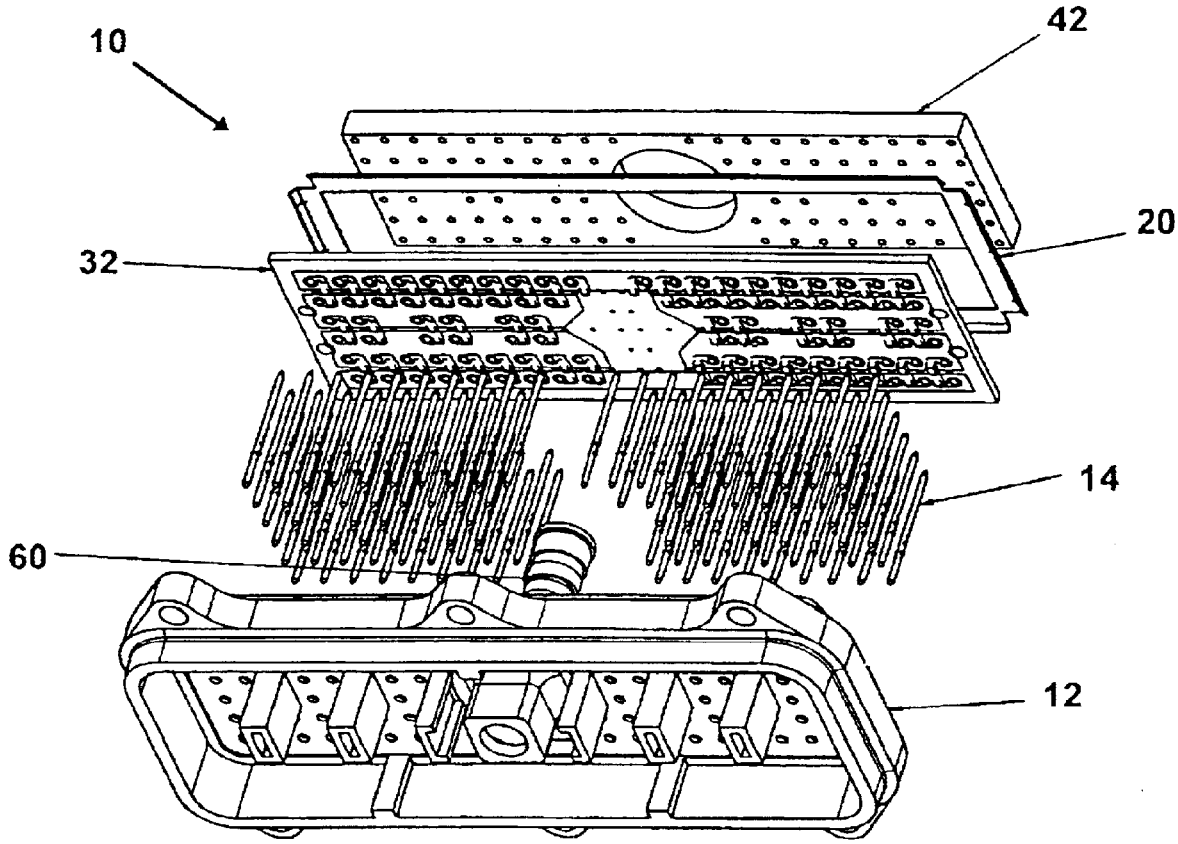
FIG. 3 is an exploded three dimensional view showing the components of a pin header assembly including both filter components and a ground shield that can be mounted within a metal case opening with the ground shield gripping the metal case to form a continuous ground path.

FIGS. 1 and 2 show an electrical connector assembly that can be mounted in an opening 4 is a metal case 2 that surrounds electrical or electronic components or assemblies. The electrical connector assembly includes a plug connector 6 that, typically but not necessarily, would attached to a wiring harness (not shown). The plug or mating connector 6 can be mated to and unmated from a pin header 10 that is mounted within the metal case opening 4. A bolt 62, which is part of the plug connector 6 engages a threaded insert 60 that is insert molded or otherwise restrained within the pin header housing 12. The main components of this assembly can be used in an unfiltered version, in a filtered version and a filtered and shielded version. The filtered, but unshielded version is shown in FIGS. 1 and 2. Filtering and shielding can be added to the pin header 10 without changing other components. Conversely filtering and shielding can be removed from the pin header 10, which can then be employed in an unfiltered version. This capability will allow use of the same basic connector assembly in different applications, some of which require filtering and/or shielding, while other applications do not require either. This capability will also permit filtering and/or shielding to be added in the event of problems in isolated cases. This overall capability is especially important for automotive applications, but the use of electrical connectors in accordance with this invention is not limited to automotive applications.

The filtered version of this electrical connector assembly shown in FIGS. 1 and 2 includes a printed circuit board 32 on which a plurality of filter capacitors have been mounted on one side of the printed circuit board. A ferrite block 42 is mounted on the opposite side of the printed circuit board, and in the preferred embodiment the ferrite block or blocks 42 are mounted on the printed circuit board by means of an adhesive. The ferrite block 42, and the printed circuit board 32 on which capacitors 40 are mounted are commonly employed to provide shielding in an electrical connector assembly.

The pin header 10 includes a molded, nonconductive housing 12 in which an array of terminals 14, in the form of pins, are mounted. Each terminal pin 14 extends through a corresponding hole in the pin header housing 12, which can be attached to the metal case 2 by conventional mounting means, such as screws or adhesives (not shown). In the unshielded version of FIGS. 1 and 2, a ground plane 34, shown in FIG. 6, can be bonded to the metallic case 2 by a bead of conductive sealant 44 as shown in FIG. 2. Alternatively the conductive sealant 44 can be replaced by a resilient strip metallic conductive member, commonly referred to as a conductive rope, which will comprise an electrical path between the ground plane 34 and the metallic case 2.

FIG. 3 shows a ground shield member 20 that can be mounted on the printed circuit board 32 to add shielding to the electrical connector assembly shown in FIGS. 1 and 2. The ferrite block 42 and the printed circuit board 32 with capacitors mounted thereon are the same as that shown in FIGS. 1 and 2, but the ground shield 20 provides a means to mechanically grip the metal case 2 along the edges of the case opening 4 to provide a continuous electrical ground, without requiring additional assembly steps. This ground shield also provides an electrical path to the metal case on all sides of the ground shield resulting in a relatively short ground path, which is significant for efficient electrical grounding and filtering.

Figure 4:
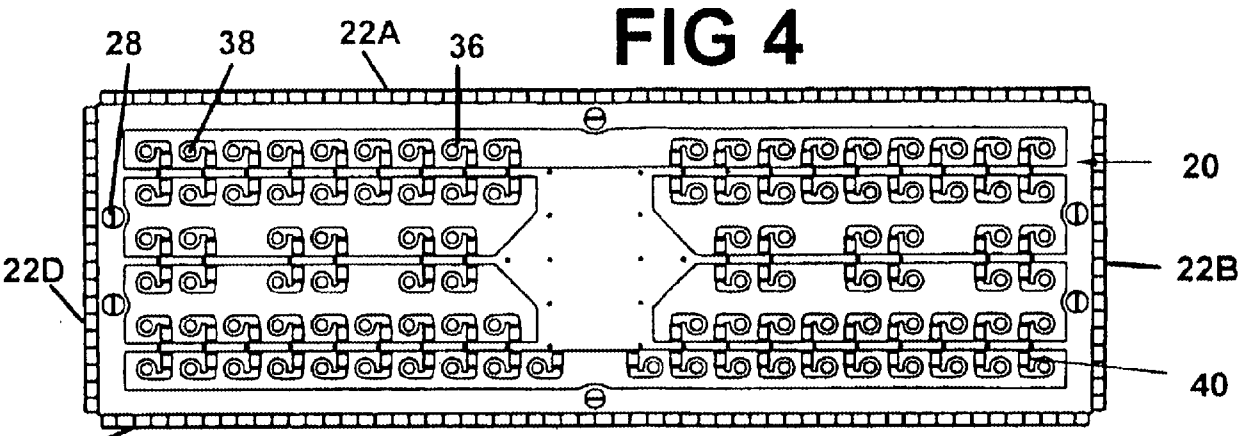
FIG. 4 is a view of the component side of a printed circuit board assembly including a ground shield mounted on the peripheral edges of a filter printed circuit board.
Figure 5:
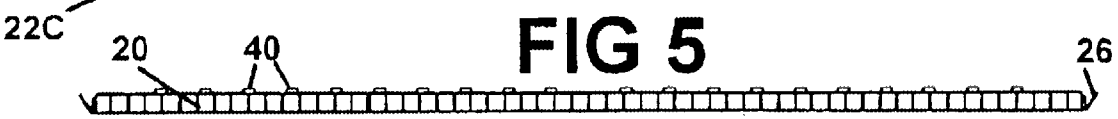
FIG. 5 is a view of one side of the printed circuit board assembly shown in FIG. 4.
Figure 6:
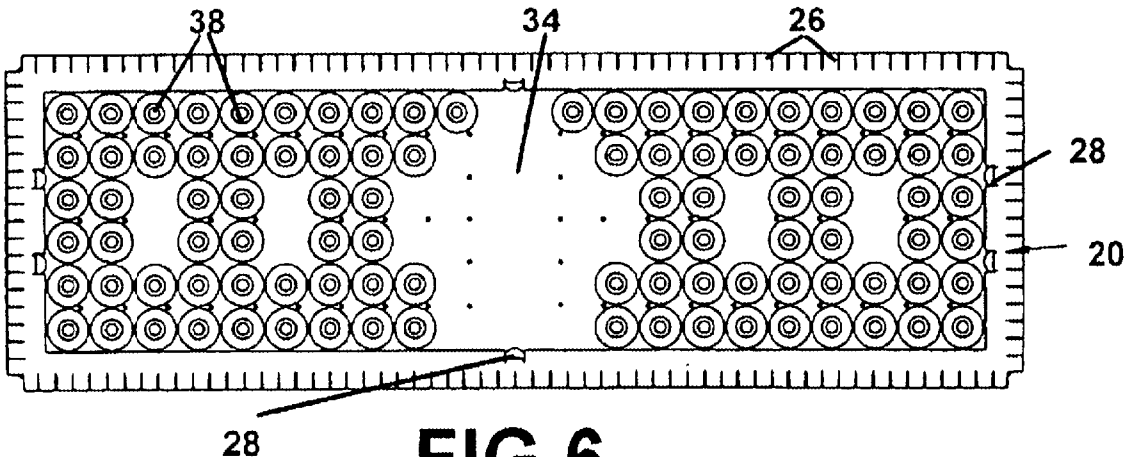
FIG. 6 is a view of the ground plane side of the printed circuit board assembly shown in FIGS. 4 and 5.

FIGS. 4–6 show a printed circuit board assembly in which the ground shield member 20 is mounted on the printed circuit board 32. FIG. 2 shows capacitors 40 mounted between pairs of holes 38 extending through the printed circuit board. In the preferred embodiment, these holes 38 are plated through holes, and the capacitors are soldered to surface mount pads 36 extending from copper forming corresponding plated through holes 38 in conventional fashion. The opposite side of the printed circuit board 32 has a ground plane 34 formed by copper plated on the printed circuit board substrate. As shown in FIG. 6, this ground plane 34 is recessed from the plated through holes 38. The shield member 20 is mounted along the edges of the printed circuit board 32 so that the shield member 20 has four peripheral edges 22 A–D that are located adjacent to corresponding edges of the printed circuit board 32. It should be understood that FIGS. 4–6 show the circuit board pattern for use with a ninety-eight position pin header 10. Clearance for the bolt 62 would also be provided in the middle of this printed circuit board assembly.

Figure 7:
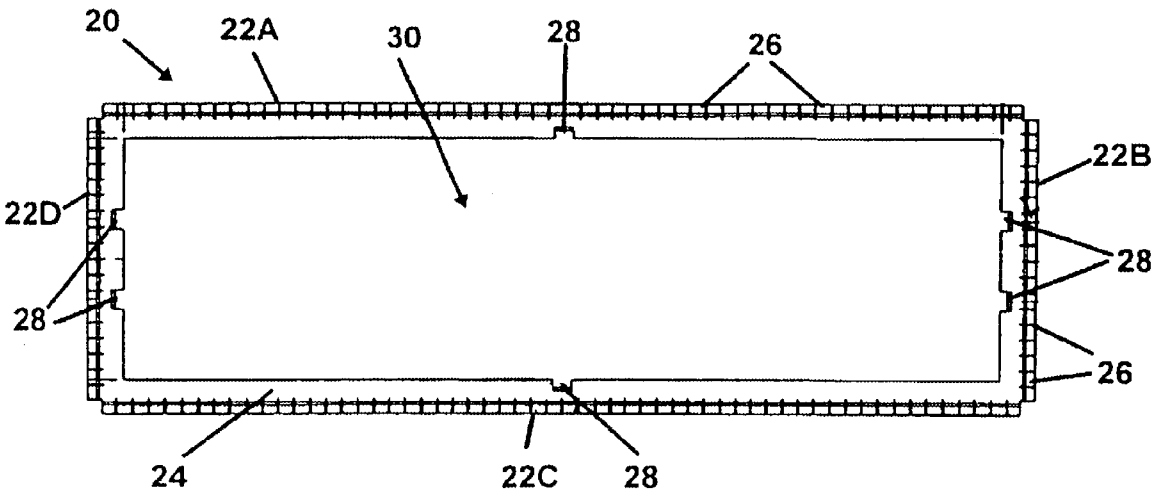
FIG. 7 is a view of the ground shield member included in the printed circuit board assembly of FIGS. 4–6.
Figure 9:
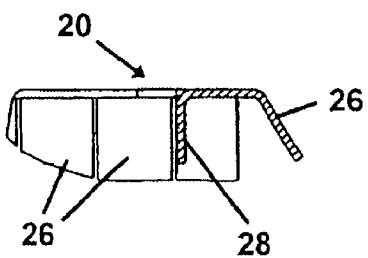
FIG. 9 is a section view showing one of the cantilever tangs in section and one of the mounting tabs in section.
Figure 8:
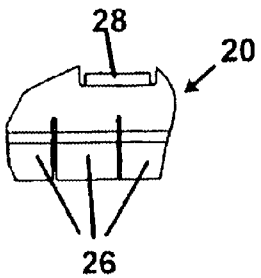
FIG. 8 is a view of a portion of the ground shield member shown in FIG. 7, showing one mounting tab adjacent to segmented cantilever tangs extending along one side of the ground shield member.

Additional details of the printed circuit board ground shield member 20 are shown in FIGS. 7–9. As seen in FIG. 7, the ground shield member 20 is in the form of a four sided frame with a central opening 30. When mounted on the printed circuit board 32, the central opening 30 would provide sufficient space for the capacitors 40 soldered to the printed circuit board 32. Segmented cantilevered tangs 26 extend along the four shield member edges 22 A–D. As can be seen best in FIG. 9, each tang 26 extends at an acute angle relative to the central shield frame portion 24 that surrounds the central clearance opening 30. In the preferred embodiment, these tangs 26 extend at an angle of sixty degrees relative to the flat plane containing the central frame portion 24. Adjacent tangs 26 are separated by slits or slots that are stamped during the stamping and forming operation used to fabricate the shield member 20. The segmented cantilever tangs 26 thus can act somewhat independently of each other when the tangs 26 engaged inner edges of the metal case opening 4. No tangs 26 are located at the four corners of the rectangular shield member 20, providing clearance when the tangs at adjacent end are bent upwardly to the sixty degree angle employed in the preferred embodiment. Since a plurality of substantially independent tangs 26 are located along all four sides, a significant degree of float is possible between the shield member 20 and the metal case. This float means that the shield member 20 can accommodate a wider range of opening sizes, or can permit looser component tolerances. This float also helps maintain a good mechanical grip, and electrical connection in the presence of vibrations and forces encountered in normal automotive operations and especially in off road motor vehicle operations.

The printed circuit board shield member 20 can be mounted to printed circuit board by mounting tabs 28 that are formed at right angles to the plane of the central frame portion 24. Alternatively the mounting tabs 28 can be used to position or align the shield member 20 relative to the printed circuit board, and the printed circuit board can be soldered to the shield member 20. Mounting tabs 28 are located along each of the four sides of the shield member 20, and these tabs 28 extend upwardly through holes in the printed circuit board 32 where the tabs can be soldered to the ground plane 34 or otherwise attached to the printed circuit board 32.

The segmented cantilever tangs 26 engage the metal case with a pin header assembly including a printed circuit board 32, including a shield member 20 is inserted into the case opening 4. FIG. 3 shows the front of such a pin header assembly. As viewed in FIG. 3, the rear end of the pin header assembly would be inserted into the metal case opening 4 so that the segmented cantilever tangs 26 would extend upwardly when viewed in the same orientation as FIG. 1. The distal ends of the tangs 26 would be the last part of these segmented cantilever members to be inserted into the case opening, but these relatively sharp distal ends would dig into and grip the edge surface of the case 2 forming the opening 4. Deflection of the angled cantilever tangs would generate a spring force tending to urge the tang distal ends into engagement with the metal case 2 to maintain a secure mechanical and electrical gripping connection to the case. No separate operation to ground the shield member 20 to the metal case 2 would be required. With the tangs bent accordingly, the connector assembly can be inserted into the metal case from either side.

Figure 10:
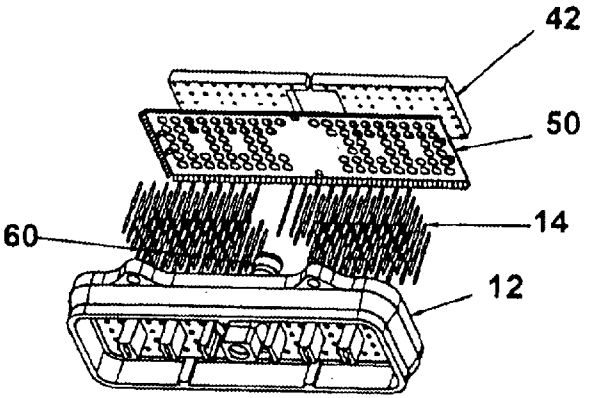
FIG. 10 is a view of an alternate pin header assembly that is similar to the embodiments of FIGS. 3–9, but which does not employ a printed circuit board with capacitive filter elements.
Figure 11:
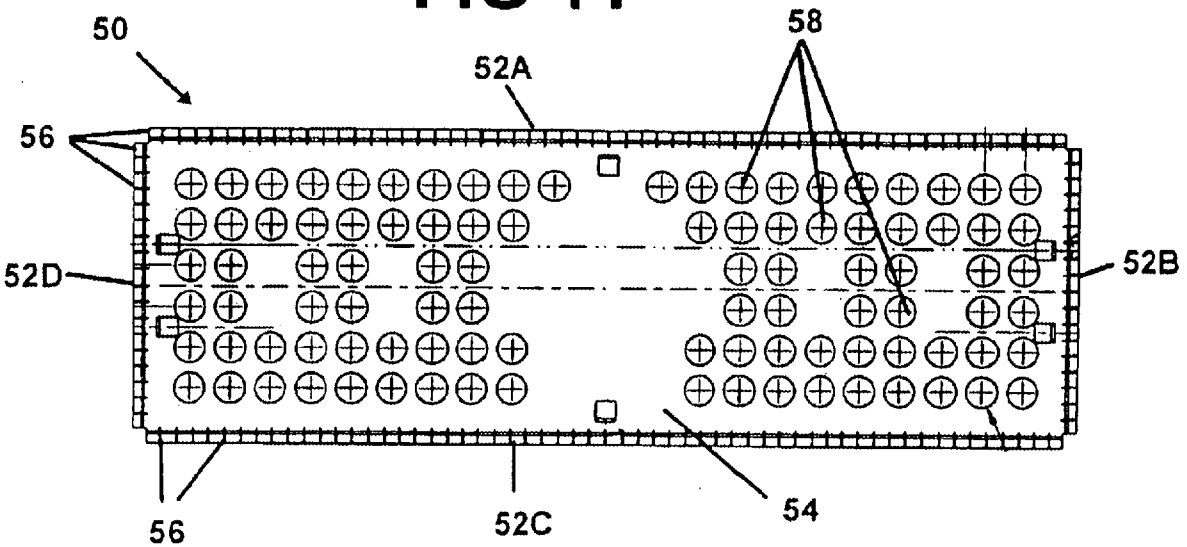
FIG. 11 is a top plan view of the ground shield member shown in FIG. 10.
Figure 12:
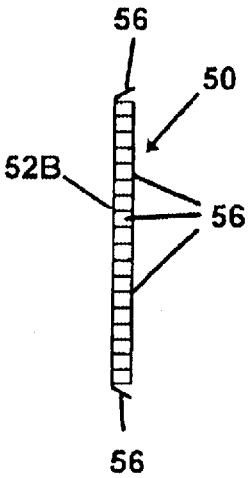
FIG. 12 is a view of one end of the ground shield member shown in FIG. 11.

The same approach to attaching a shield member can be employed even in applications in which capacitive filtering, provided by capacitors 40 mounted on a printed circuit board would not be required. FIGS. 10–12 show a shielding embodiment in which capacitive filtering is not required. In this embodiment the shield 50 has an array of holes 58 located in a central portion 54 bordered by four rectilinear peripheral edges 52 A–D. These holes 58 are located in the same configuration as the array of terminal pins 14. The diameter of each hole 58 is sufficient to provide clearance for the individual pins 14 which extend through corresponding holes 58. Ferrite blocks 42 can be secured to this shield 50. The ground shield 50 includes segmented cantilever tangs 56 extending along the peripheral edges in the same manner as for the embodiment of FIGS. 7–9, and tangs 56 engage the case 2 in the same manner as tangs 26. The ground shield 50 can be substituted for the ground shield 20, and either ground shield can be inserted into an unshielded and unfiltered pin header to meet the needs of a specific application. The same pin header housing 12 and terminal pins 14 can be used in both unfiltered and filtered applications, thus reducing the inventory required for automotive or other applications.

The embodiments depicted herein are merely representative and a number of modifications would be apparent to one of ordinary skill in the art. Therefore the invention is defined terms of the following claims and is not limited to the details of either of these embodiments.

We claim:

1. A shielded printed circuit board header assembly insertable into and mountable in an opening in an electrically conductive case, the assembly comprising:

a molded nonconductive housing;

terminals mounted in the housing; and a ground shield engaging the case when the header assembly is mounted within the opening, peripheral edges of the ground shield extending at an angle relative to a central portion of the ground shield, the peripheral edges being segmented to form independent side by side segmented cantilever tangs comprising means for engaging the case along edges of the case to electrically common the ground shield to the case and to mechanically grip the case;

wherein segmented cantilever tangs extend completely around the periphery of the ground shield.

2. The shielded printed circuit board header assembly of claim 1 wherein the ground shield comprises a stamped and formed metallic member.

3. The shielded printed circuit board header assembly of claim 2 wherein the shield is rectangular with segmented cantilever tangs extending along four sides of the rectangular shield.

4. The shielded printed circuit board header assembly of claim 1 wherein the segmented cantilever tangs extend at an acute angle relative to the central portion of the ground shield.

5. The shielded printed circuit board header assembly of claim 1 wherein the central portion of the ground shield includes a series of holes through which the terminals extend.

6. The shielded printed circuit board header assembly of claim 5 wherein alignment tabs extend perpendicular to the central portion and beside and along an interior of a portion of the segmented cantilever tangs.

7. A shielded printed circuit board header assembly insertable into and mountable in an opening in an electrically conductive case, the assembly comprising:

a molded nonconductive housing;

terminals mounted in the housing; and a ground shield engaging the case when the header assembly is mounted within the opening, peripheral edges of the ground shield extending at an angle relative to a central portion of the ground shield, the peripheral edges being segmented to form independent side by side segmented cantilever tangs comprising means for engaging the case along edges of the case to electrically common the ground shield to the case and to mechanically grip the case the ground shield comprising a frame having an open center with the shield being disposed along sides of the printed circuit board and with the segmented cantilever tangs disposed coplanar with and extending along edges of the printed circuit board.

8. The shielded printed circuit board header assembly of claim 2 wherein segmented cantilever tangs extend completely around the periphery of the ground shield.

9. The shielded printed circuit board header assembly of claim 8 wherein the ground shield is soldered to the printed circuit board.

10. The shielded printed circuit board header assembly of claim 9 wherein the printed circuit board includes ground plane means recessed from printed circuit board openings though which the terminals extend.

11. The shielded printed circuit board header assembly of claim 10 wherein filter capacitors are soldered to an opposite side of the printed circuit board.

12. The shielded printed circuit board header assembly of claim 1 including a ferrite attached to at least a portion of the terminals.

13. The shielded printed circuit board header assembly of claim 1 wherein the terminals comprise pins.

14. The shielded printed circuit board header assembly of claim 1 including a printed circuit board and a conductive sealant disposed around the printed circuit board to engage the case.

* * * * *